United States Patent [19]

Yamaguchi

[11] Patent Number: 4,697,983

[45] Date of Patent: Oct. 6, 1987

[54] STEAM INTRODUCING PART STRUCTURE OF STEAM TURBINE

[75] Inventor: Hiroshi Yamaguchi, Hitachi, Japan

[73] Assignee: Hitachi, Ltd., Tokyo, Japan

[21] Appl. No.: 785,599

[22] Filed: Oct. 8, 1985

[30] Foreign Application Priority Data

Oct. 15, 1984 [JP] Japan ..... 59-214373

[51] Int. Cl.[4] ..... F01D 25/26

[52] U.S. Cl. ..... 415/134

[58] Field of Search ..... 415/134, 138, 136, 139; 285/370

[56] References Cited

U.S. PATENT DOCUMENTS

| | | | |
|---|---|---|---|
| 1,415,571 | 5/1922 | Junggren | 415/136 |
| 2,527,446 | 10/1950 | Jenks, Jr. et al. | 415/139 |
| 2,800,299 | 7/1957 | Sheppard et al. | 415/136 |
| 2,956,775 | 10/1960 | Brinkman et al. | 415/134 |

FOREIGN PATENT DOCUMENTS

| | | | |
|---|---|---|---|
| 128343 | 12/1984 | European Pat. Off. | 415/139 |
| 1030358 | 5/1958 | Fed. Rep. of Germany | 415/134 |
| 132405 | 10/1981 | Japan | 415/134 |
| 178806 | 10/1983 | Japan | 415/136 |
| 389308 | 3/1933 | United Kingdom | 415/134 |
| 752756 | 7/1956 | United Kingdom | 415/134 |
| 912520 | 10/1962 | United Kingdom | 415/134 |

*Primary Examiner*—Robert E. Garrett
*Assistant Examiner*—John Kwon
*Attorney, Agent, or Firm*—Fay, Sharpe, Beall, Fagan, Minnich & McKee

[57] ABSTRACT

A main steam introducing part structure of a steam turbine comprises an outer casing, an inner casing disposed in the outer casing, a 180° nozzle box disposed in the inner casing, and a steam introducing pipe passing through the outer and inner casings and introducing main steam from the outer casing into the nozzle box. The steam introducing pipe has, at the middle, a flange airtightly secured to the inner casing with bolts, and one end of the pipe is inserted into a hole of the outer casing through a seal ring and the other end into the steam inlet portion of the nozzle box through a seal ring. This construction is mechanically stable and easy to convert a steam turbine with 90° nozzle box into a steam turbine with 180° nozzle box without newly producing the inner casing.

4 Claims, 8 Drawing Figures

STEAM INTRODUCING PART STRUCTURE OF STEAM TURBINE

BACKGROUND OF THE INVENTION

This invention relates to a structure of a steam introducing part of a steam turbine, which part introduces main steam into a nozzle box through turbine casings.

In a main steam introducing part of a large capacity steam turbine, an inner casing is provided in an outer casing, and a nozzle box is disposed in the inner casing. A main steam passage passes through the outer and inner casing walls and communicates with the nozzle box, whereby the main steam is fed to the nozzle box through the main steam passage. In the portion of the inner and outer casings through which the passage passes, an expansion joint is provided to allow thermal expansion or contraction and to introduce main steam from the outer casing into the nozzle box.

The above-mentioned nozzle box has an annular shape as a whole, and is of two kinds, one of which has a chest of the first stage nozzle which is divided circumferentially into four 90° type nozzle boxes and the other two 180° type nozzle boxes.

The above-mentioned 90° type nozzle box, which is an early type, has a steam pipe portion which is a part of the nozzle box and extends to the outer casing through the inner casing for introducing main steam into the nozzle box. The nozzle box is fixed to the inner casing at the position that the steam pipe portion passes through the inner casing. Therefore, the nozzle chest which faces the first stage moving blades of a rotor is hung by the inner casing. This structure has an advantage that the nozzle box can freely extend without any restriction on the thermal expansion. The 90° nozzle box also has disadvantages that it is unstable to the nozzle reaction and microvibrations caused by the steam flows during the operation of the turbine.

According to a mounting method, the 90° nozzle box has two types one of which is fixed to the inner casing by utilizing the steam introducing pipe portion, the other fixed to the inner casing by fastening the chest portion with bolts from the inner casing side so that the chest portion is hung by the inner casing as above-mentioned.

The 90° nozzle box has the above-mentioned disadvantage, so, recently, the 180° nozzle box is used. This nozzle box is divided into two parts by a horizontal plane at the first stage nozzle chest portion, the lower half nozzle box is supported on the horizontal face of the inner casing and the upper half nozzle box is fixed to the lower half nozzle box by bolts. The construction is not restricted to the expansion, what's more, it is stable even when the nozzle reaction and microvibrations take place due to steam flows.

The steam introducing part of the turbine with 180° nozzle box is provided with a steam conduit which is independent of the inner and outer casing and the nozzle box, passes through the inner casing and is engaged with the outer casing and the nozzle box at the end portions. At the portions of the inner and outer casings and the nozzle box, through which the steam conduit passes through, seal rings are provided to prevent steam leakage.

Recently, a preventive maintenance activity for raising the reliability of turbine parts or elements has been activated, so, change of a turbine with 90° nozzle box to a turbine with 180° nozzle box has been put into practice.

The above-mentioned change of turbines from a turbine with 90° nozzle boxes to one with 180° nozzle box is difficult according to types of the 90° nozzle boxes.

Improvement of a used steam turbine with 90° nozzle box by changing it to a steam turbine with 180° nozzle box is disclosed in "Hokkaido Thermal and Nuclear Power Generation News" issued by Thermal and Nuclear Power Generation Technique Association Hokkaido Branch on March of 1983, paragraph 4 of the nozzle box and diaphragm item, pp 8. According to this literature, the improvement can be effected by newly manufacturing the 180° nozzle box and modifying the inner casing. This improvement, however, is concerned with only a turbine with the above-mentioned 90° nozzle box fixed to the inner casing by making use of the steam introducing pipe portion as mentioned above.

As for the used turbine with the 90 nozzle box fixed by bolts at its chest portion, the improvement of the turbine by changing the 90° nozzle box to the 180° nozzle box is not put into practice, for the reasons that the steam introducing pipe and the 180° nozzle box can not be enclosed in the inner casing by only modifying the inner casing, and that the nozzle box, the steam introducing pipe and the inner casing are necessary to produce new products, so that the improved or reconstructed turbine will be high in cost.

SUMMARY OF THE INVENTION

An object of the invention is to provide a steam introducing part structure of a steam turbine suitable for changing a steam turbine with 90° nozzle box of type secured to the inner casing by bolts to a steam turbine with 180° nozzle box without exchanging the inner casing for a new one.

The steam introducing part structure of a steam turbine according to the present invention is characterized in that an expansion joint passing through the inner casing and communicating with the main steam inlet and the nozzle box, for introducing main steam from the main steam inlet into the nozzle box, is formed of a steam introducing pipe passing through the inner casing and having a flange at the middle portion, the flange being airtightly secured to the inner casing, and one end of the steam introducing pipe being slidably airtightly inserted in a hole of the outer casing and the other end being slidably air tightly inserted in the inlet of the nozzle box.

This structure enables a steam turbine with 90° nozzle box of the type secured to the inner casing by bolts, which has been already made, to be changed to a steam turbine with 180° nozzle box without newly manufacturing the inner casing. The 180° nozzle box has a plurality of nozzles arranged in the chest in a range of about 180°. The two nozzle boxes are secured to the inner casing at the horizontal flat portion and to each other so that the nozzle boxes are mechanically stable. The steam introducing pipe is secured to the inner casing at the flange, and the ends thereof are slidable on the outer casing and the nozzle box, so that the pipe is mechanically stable.

DESCRIPTION OF THE PREFERRED EMBODIMENT

Figure 1:
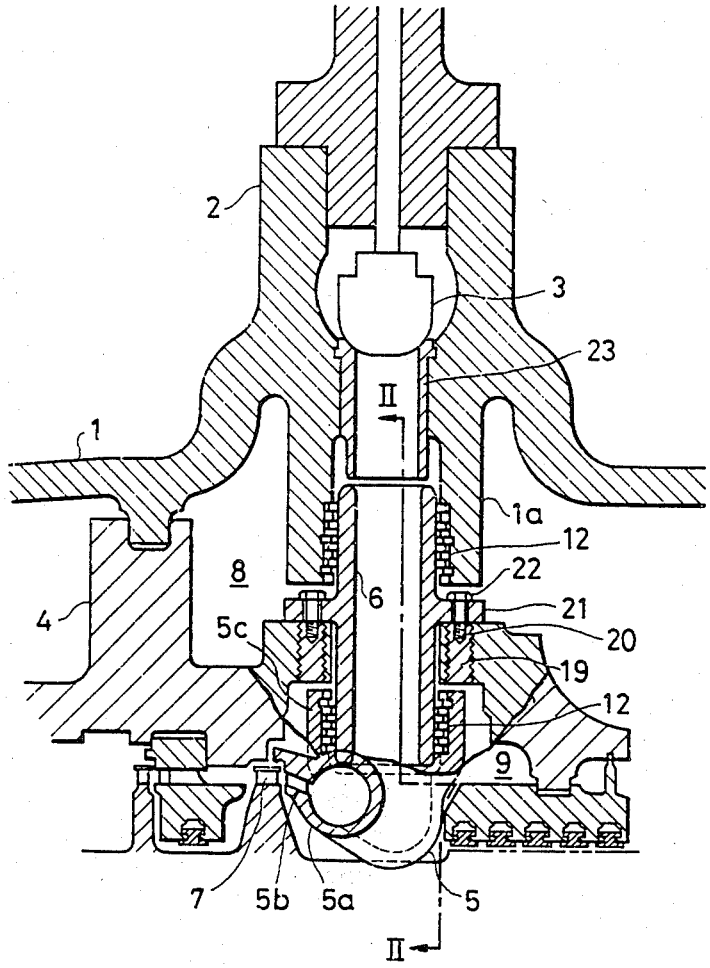
FIG. 1 is a sectional view of the vicinity of a steam introducing part of a steam turbine of an embodiment of the present invention.

An embodiment of the present invention is described hereunder in detail referring to the drawings.

Figure 2:
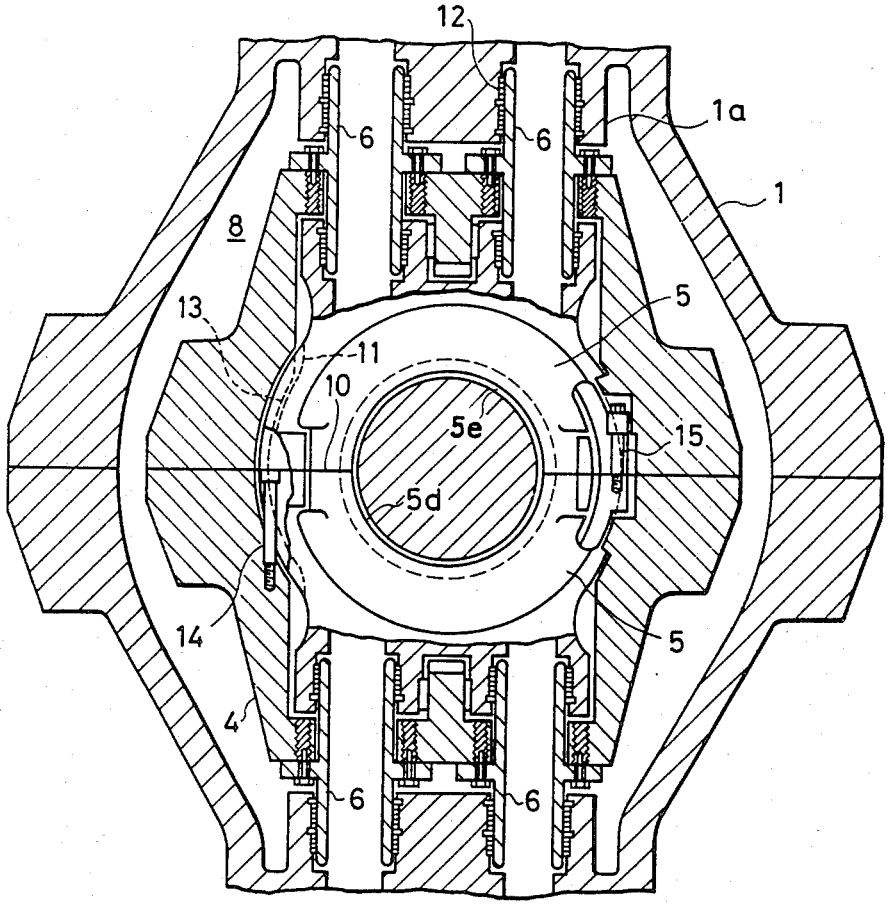
FIG. 2 is a sectional view of the steam introducing part taken along a line 2—2 of FIG. 1.

In FIGS. 1 and 2 showing a steam introducing part of a steam turbine with an outer casing 1 is divided into upper and lower halves which are assembled together. Each half of the outer casing 1 is provided with two main steam inlets 2, and steam inflow parts 1*a* projecting inwards therefrom. In the main steam inlet 2, a main steam control valve 3 is inserted. The valve 3 is slidable held by a plug secured to the inlet 2, and set on a valve seat pipe 23 inserted in the inlet hole. An inner casing 4 is disposed in the outer casing 1, and divided into upper and lower halves which are assembled together by bolts. In the inner casing 4, upper and lower half 180° nozzle boxes 5*d*, 5*e* are inserted. The lower half nozzle box 5*d* is inserted in the lower half inner casing 4 so as to carry out arc-like boss and groove engagement between the inner casing and the nozzle box and is secured to the inner casing by bolts 14. The upper half nozzle box 5*e* is disposed on the lower half nozzle box 5d so as to carry out arc-like boss and groove engagement between the inner casing and the nozzle box and is secured to the lower half nozzle box by bolts 15. Each of the nozzle boxes 5 has a chest 5*a*, first stage nozzles 5*b* and a nozzle inlet 5*c* which aligns with the main steam inlet 2 and introduces main steam into the nozzles 5*b* through the chest 5*a*. The first stage nozzles 5*b* face first stage moving blades 7 of a rotor with a small distance, whereby the steam from the nozzles 5*b* impinges on the moving blades 7 so that the moving blades are moved to rotate the rotor.

A steam introducing pipe 6 is provided between the nozzle inlet 5*c* and the outer casing 1 through a steam introducing pipe receiving hole 17 formed in the inner casing 4. The steam introducing pipe 6 has a flange 21 in the middle portion, and is secured airtightly to the inner casing 4 by fastening the flange 21 on the seal face of the inner casing 4 with bolts 22. Seal rings 12 are provided between the steam introducing pipe 6 and the nozzle inlet 5*c*, and between the pipe 6 and the inflow part 1*a* of the outer casing, respectively. The main steam of high temperature and pressure entered the main steam inlet 2 is introduced into the nozzle box 5 through the steam introducing pipe 6. The nozzle box 5 expands upward and downward from the horizontal abutment 10 of the upper and lower half nozzle boxes 5*d*, 5*e*, on the thermal expansion, whereby the nozzle inlets of the upper half nozzle box extend upward, and the nozzle inlets of the lower half nozzle box 5*d* extend downward. On the other hand, the steam introducing pipe 6 receives heat from the main steam and expands downward at the lower portion of the flange 21 and upwards at the upper portion. Therefore, large relative movement of the steam introducing pipe to the outer casing is not caused, which is unlikely to leak, at the sealing, into a space 8 defined by the inner and outer casings 1,4 which space forms a pressure chamber for low temperature reheat steam. A space 9 around the nozzle box 5, which forms a pressure chamber for steam reduced in pressure after working at the first stage, is relatively high in pressure. The steam in the space 9 is prevented from leakage into the space 8 because the flange 21 of the steam introducing pipe 6 is tightly secured to the seal face of the inner casing 4.

Thus, the steam introducing pipe 6 is airtightly secured to the inner casing 4 by the flange 21, and can freely extend axially at both ends so that the pipe 6 will not apply undue forces on any portions, upon thermal expansion of the pipe 6. Therefore, the structure is mechanically stable.

Next, modification or reconstruction of a steam turbine with 90° nozzle boxes so as to have 180° nozzle boxes is described hereunder.

Figure 7:
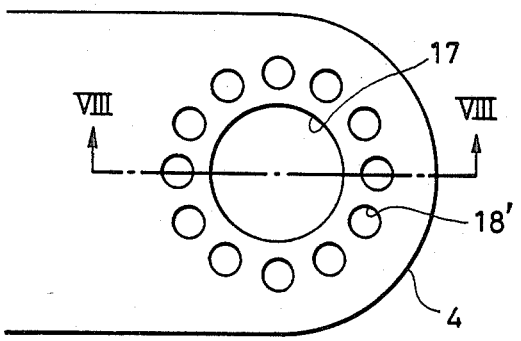
FIG. 7 is a plan view of a steam inlet portion of an inner casing used in FIG. 5.
Figure 8:
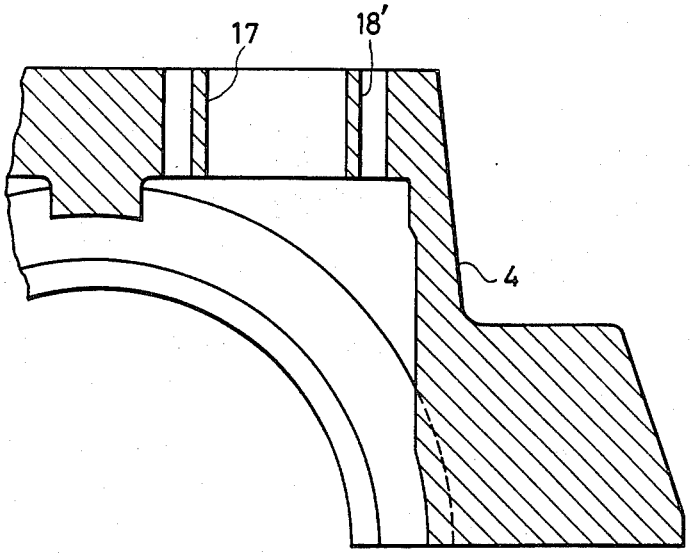
FIG. 8 is a sectional view of the steam introducing part taken along a line 8—8 of FIG. 7.

In FIGS. 5 to 8, a steam introducing part of the steam turbine with 90° nozzle boxes is shown. First, the 90° nozzle box is briefly described. The nozzle box 5' has a chest 5*a'* which is shaped in an arc of about 90°, nozzles 5*b'* formed in the chest, a flange 26 having a seal face 25, and a steam introducing pipe portion 6' which is a part of the nozzle box 5'. The nozzle box 5' is mounted on the inner casing 4 by fastening the flange 26 on the inner casing 4 with bolts 24, so that the chest 5*a'* is hung. The chest 5*a'* receives reaction when the steam is jetted from the nozzles 5*b'*, therefore, the chest is secured to the inner casing 4 by key means 27. The key means 27 are points from which the nozzle box is axially extended on thermal expansion and which receives the axial reaction caused by the steam jet. Irrespective of the provision of the key means, the nozzle box 5' is mechanically unstable because of its hanging construction. The inner casing 4 has a plurality of through-holes 18' for the bolts 24 arranged around a hole 17 for receiving the steam introducing pipe portion 6' of the nozzle box 5', as shown in FIGS. 7 and 8.

An embodiment of the modification or reconstruction of the steam turbine with 90° nozzle box as mentioned above so as to have the 180° nozzle box is described referring to FIGS. 1 to 4.

Figure 3:
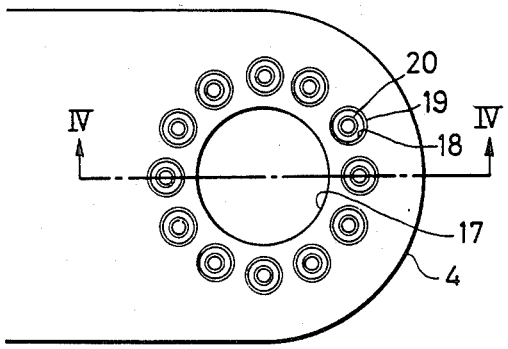
FIG. 3 is a plan view of the steam introducing part of an inner casing shown in FIG. 1.
Figure 4:
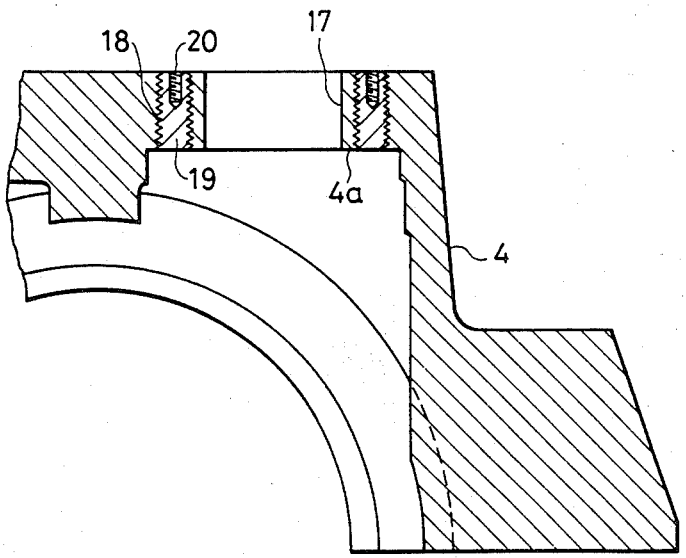
FIG. 4 is a sectional view of the steam introducing part taken along a line 4—4 of FIG. 3.
Figure 6:
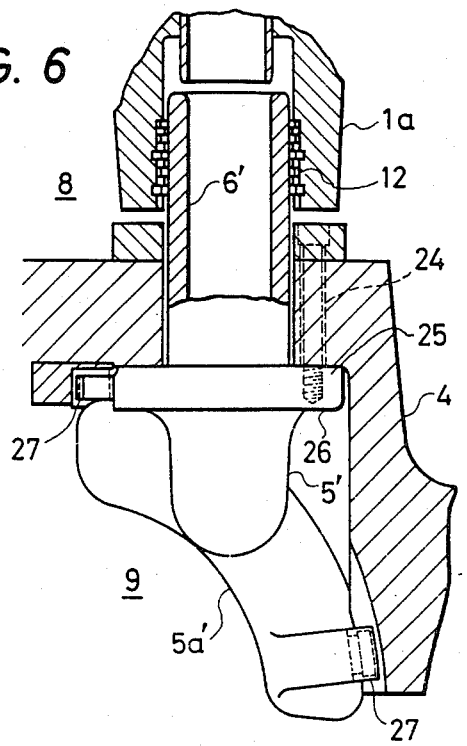
FIG. 6 is a sectional view of the steam introducing part taken along a line 6—6 of FIG. 5.
Figure 5:
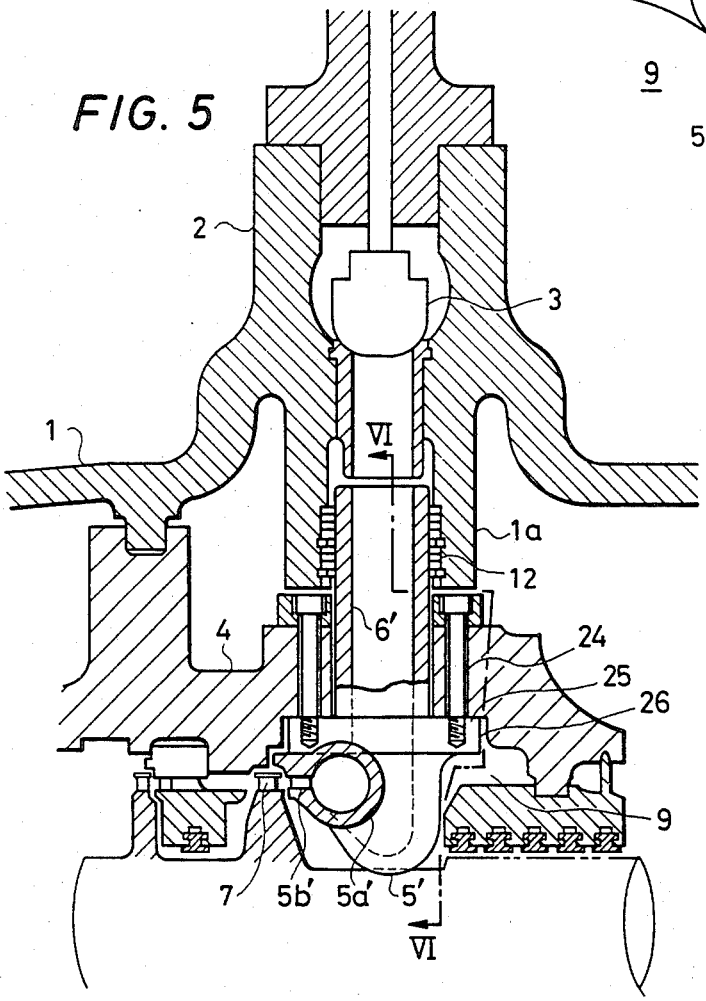
FIG. 5 is a sectional view of the vicinity of a steam introducing part of a steam turbine employing 90° nozzle boxes fixed to an inner casing by bolts.

The outer casing 1 is used without modifying one as shown in FIG. 5. The inner casing 4 is preferably a little modified, namely, as shown in FIGS. 3 and 4, the plurality of through-holes 18 around the steam introducing pipe receiving hole 17 have threads therein and are airtightly closed with plugs 19. The each plug 19 has a thread hole 20 formed therein. The inner face 4*a* ,of the inner casing 4 is preferably reduced for mounting the inlet portion 5*c* of the 180 nozzle box 5 thereon. Further, the insides 11 and 13 of the inner casing 4 may be reduced to let the 180° nozzle box be suited to the inside of the inner casing 4, depending on kinds of the inner casing which has employed the 90° nozzle box.

The 180° nozzle box 5, which itself is well-known, is newly manufactured. The steam introducing pipe 6 which is independent of the 180° nozzle box 5 also is newly manufactured. The pipe 6 is mounted on the inner casing 4 by fastening the flange 21 of the pipe 6 on the seal face of the inner casing 4 with the bolts 27 being screwed in the threaded holes 20 of the plugs 19. The steam turbine with 180° nozzle box is thus constructed, as shown in FIGS. 1 and 2.

As above-mentioned, according to the embodiment of the present invention, the turbine with 90° nozzle box which has been already made is easy to be changed into the turbine with 180° nozzle box without newly manufacturing the inner casing so that a turbine with a high reliability can be made without raising the cost.

What is claimed is:

1. A steam introducing part structure of a steam turbine having a rotor with first stage moving blades, comprising:

an outer casing with a main steam inlet;

an inner casing disposed in and separate from said outer casing;

a 180 degree nozzle box disposed in and separate from said inner casing and having a chest and nozzles which are formed in an arc of about 180 degrees in said chest and face the first stage moving blades of the rotor, said 180 degree nozzle box being secured to said inner casing about a horizontal abutment face thereof;

a steam introducing pipe provided between the outer casing and nozzle box and passing through said inner casing for introducing main steam from said main steam inlet of said outer casing into said nozzle box;

said steam introducing pipe having a flange about the middle portion, and being separate from and independent of each of said inner and outer casings and said nozzle box, said flange of said steam introducing pipe being provided with a plurality of through holes arranged circumferentially;

said steam introducing pipe being airtightly secured to said inner casing by fastening said flange on said inner casing with bolts, screwed in threaded holes provided in said inner casing at the positions corresponding to said through holes through said through holes of said flange;

one end portion of said steam introducing pipe being airtightly and slidably inserted in a hole formed in said outer casing at the main steam inlet portion through a seal ring, and the other end portion being inserted in a steam inlet of said nozzle box through a seal ring, for providing expansion of respective ends of said steam introducing pipe relative to said outer casing and said nozzle box so that the main steam from said main steam inlet is introduced into said nozzle box.

2. The steam introducing part structure as defined in claim 1, wherein said threaded holes are formed in plugs each of which is screwed in a threaded hole formed in said inner casing at the position corresponding to said hole of said flange.

3. A steam introducing part structure of a steam turbine having first stage moving blades of a rotor, comprising:

an outer casing with a main steam inlet;

an inner casing disposed in said outer casing;

a pair of 180 degree nozzle boxes each formed in an arc of about 180 degrees and having a substantially horizontal abutment face, each of said 180 degree nozzle boxes being disposed in said inner casing so that said substantially horizontal abutment faces contact with each other, and having a chest and nozzles which are formed in said chest and face the first stage moving blades of the steam turbine rotor; and expansion joints each provided between said outer casing and said nozzle box so as to pass through said inner casing for introducing main steam from said main steam inlet of said outer casing into said nozzle box, each of said expansion joints being formed of a steam introducing pipe having a flange about the middle portion thereof and being independent of said outer casing, said inner casing and said nozzle box, said flange and said steam introducing pipe being made of one piece and said flange being provided with a plurality of through holes arranged circumferentially, said inner casing being provided with a plurality of threaded holes at the positions corresponding to said through holes, and said steam introducing pipe being airtightly secured to said inner casing by fastening said flange on said inner casing with bolts screwed in said threaded holes of said inner casing through said through holes of said flange and slidable engaged with said outer casing at one end thereof and at the other end airtightly and slidably engaged with said nozzle box so that both ends of said steam introducing pipe are slidable relative to said outer casing and said nozzle box, respectively.

4. The steam introducing part structure as defined in claim 3, wherein said threaded holes are formed in plugs each of which is screwed in a threaded hole formed in said inner casing at the position corresponding to said through hole of said flange.

* * * * *